US005386950A

United States Patent [19]

Abt

[11] Patent Number: 5,386,950

[45] Date of Patent: Feb. 7, 1995

[54] APPARATUS AND METHOD FOR PREPARING INDIVIDUAL WOUND ROLLS FROM A SLITTED WEB OF MATERIAL

[76] Inventor: Richard Abt, 28 Featherbed La., Branford, Conn. 06405

[21] Appl. No.: 895,268

[22] Filed: Jun. 8, 1992

[51] Int. Cl.[6] ..... B65H 18/20

[52] U.S. Cl. ..... 242/532; 242/541.6; 242/542

[58] Field of Search ..... 242/66, 65, 56 R, 56.2, 242/56.6, 56.9, 72 B, 532, 532.2, 532.7, 541.6, 542, 542.1, 542.2

[56] References Cited

U.S. PATENT DOCUMENTS

| | | | |
|---|---|---|---|
| 1,984,784 | 12/1934 | Cameron | 242/66 |
| 3,090,576 | 5/1963 | Roder | 242/67.1 R |
| 3,250,484 | 5/1966 | Fair | 242/66 |
| 3,345,010 | 10/1967 | Egan | 242/66 |
| 3,822,836 | 7/1974 | Troyer et al. | 242/66 |
| 3,850,381 | 11/1974 | Moore | 242/DIG. 3 |
| 3,899,948 | 8/1975 | Jakob . | |
| 3,945,583 | 3/1976 | Ochs et al. | 242/72 B |
| 3,961,759 | 6/1976 | Fujiwara | 242/66 |
| 3,998,399 | 12/1976 | Held et al. | 242/65 |
| 4,003,477 | 1/1977 | Kroppenstedt . | |
| 4,374,575 | 2/1983 | Lerch et al. | 242/65 |
| 4,456,190 | 6/1984 | Karttunen et al. | 242/66 X |
| 4,485,980 | 12/1984 | Gorner | 242/66 X |
| 4,548,113 | 10/1985 | Topperworn et al. . | |
| 4,646,603 | 3/1987 | Held . | |
| 4,690,348 | 9/1987 | Watanabe et al. | 242/66 |
| 4,759,249 | 7/1988 | Held . | |
| 4,854,520 | 8/1989 | Gavin et al. | 242/56.9 X |
| 4,967,804 | 11/1990 | Gotti | 242/66 X |

*Primary Examiner*—John M. Jillions

[57] ABSTRACT

An apparatus and method for preparing individual wound rolls from a slitted web of material provides for a driver roller which continuously feeds the web of material into the apparatus, an idler roller disposed such that the web of material is fed about the driver roller and into contact with the idler roller; a core disposed such that the web of material passes between and into contact with the driver roller and the core, and the idler roller and the core; a tucking apparatus for tucking the web of material about said core; and a reciprocating roller for driving the core to initiate and continue winding of slitted web of material about the core.

5 Claims, 7 Drawing Sheets

APPARATUS AND METHOD FOR PREPARING INDIVIDUAL WOUND ROLLS FROM A SLITTED WEB OF MATERIAL

FIELD OF THE INVENTION

The present invention relates to the preparation of individual wound rolls from a slitted web of material, such as a web of stamps, to produce rolled strips of stamps.

BACKGROUND OF THE INVENTION

Recently, it has been considered desirable to affix individual postage stamps to solicitations and other mass mailings instead of using metered mail or other forms of postage. The reasoning is that the recipient is more likely to view a stamped envelope as a personalized letter. The affixing of individual stamps to a mass mailing is generally automated, and uses equipment which receives a roll of stamps. The stamps are then conveyed by a roller having pins that fit into the perforations to engage the stamp roll and convey it in the equipment. The equipment separates each stamp from the adjacent stamp by separating successive stamps from the stamp roll at a perforation line and affixes the stamps to the envelopes.

The equipment used to separate these stamps typically is capable of receiving rolls comprising a wound strip of stamps of a certain length. However, when bulk quantities of stamps are produced, they are usually a web of printed stamps in a roll which is 15 to 25 stamps wide and several thousand stamps in length. In order to separate the wound roll into strips of stamps which are one stamp wide and can be used as individual rolls of stamps, the web of stamps is generally passed through a slitting apparatus which slits the web of stamps into individual single stamp width strips. The individual single stamp strips are then rolled to form individual stamp rolls.

It would be desirable to provide an apparatus and method capable of efficiently producing wound rolls of single strips of stamps, which are of a manageable length and size.

SUMMARY OF THE INVENTION

It is an object of the invention to provide an apparatus for and method of preparing individual wound rolls from a continuous slitted web of sheet material to provide individual wound rolls of strips of material of a limited size. It is an object of the invention to provide such an apparatus and method that will continuously prepare individual wound rolls of a single strip of postage stamps that is usable in automated stamping equipment with the reduced likelihood of fouling.

These objects and others as set forth herein are provided by an apparatus and method for preparing individual wound rolls from a slitted web of material in accordance with the invention, generally comprising a set of rolls which feed a web of material about a removable core; an apparatus which tucks a leading edge of the web of material about the core; a roller which initiates winding of the slitted web of material about the core, and then removes the core from the apparatus when a desired amount of the slitted web of material is wound about the core.

Feeding of the web of material into contact with the core is accomplished by a driver roller rotating about a central axis, and an idler roller which rotates about a central axis, such that the web of material is fed about the driver roller and into contact with the idler roller. The core about which the web of material is wound is disposed in relation to the driver roller and the idler roller such that the web of material passes between and into contact with the driver roller and the core, and the idler roller and the core. The leading edge of the web of material is then tucked about the core after having contacted the idler roller by a first tucker which guides the leading edge of the web of material between the core and a rotationally driven reciprocating roller, which initiates winding of the web about the core, and a second tucker which then guides the leading edge of the web of material between the core and the driver roller.

The web is then wound about the core by the rotational action of the driver roller and the reciprocating roller, which drive the core to wind the web of material thereabout. This reciprocating roller is moveable towards the core in order to contact the web of material which has been tucked about the core and initiate the winding, and then moveable away from the core as the web of material is wound about the core, which increases core thickness. The reciprocating roller is brought into position to initiate winding of the web of material about the core after the first tucker has guided the leading edge of the web of material between the core and the reciprocating roller. The reciprocating roller then rotatably drives the core to begin winding the web of material thereabout as the second tucker is guiding the leading edge of web of material between the core and the driver roller.

After the desired amount of the web of material is wound about the core, the core is removed from its position in relation to the driver roller and the idler roller. The web of material is then cut so that the wound rolls disposed about the core can be removed, and the winding process can begin anew.

Most advantageously, the core about which the web of material is wound comprises an expandable rod which can be deflated after removal from the apparatus of the invention in order to facilitate removal of the wound rolls from the core. Since the web of material wound about the core is slitted length wise, it can be removed as individual coreless wound rolls of strips of material such as stamps.

In order to coordinate the actions of the various elements of the apparatus, it is desired that the driver roller and both tuckers are synchronized by a common drive means or computerization which permits coordination of efforts to facilitate forming of the individual wound rolls.

Other objects, aspects, and features of the present invention in addition to those mentioned above, will be pointed out in, or will be understood from the following detailed description, provided in conjunction with the accompanying drawings.

DETAILED DESCRIPTION OF THE PREFERRED EMBODIMENT

Figure 1:
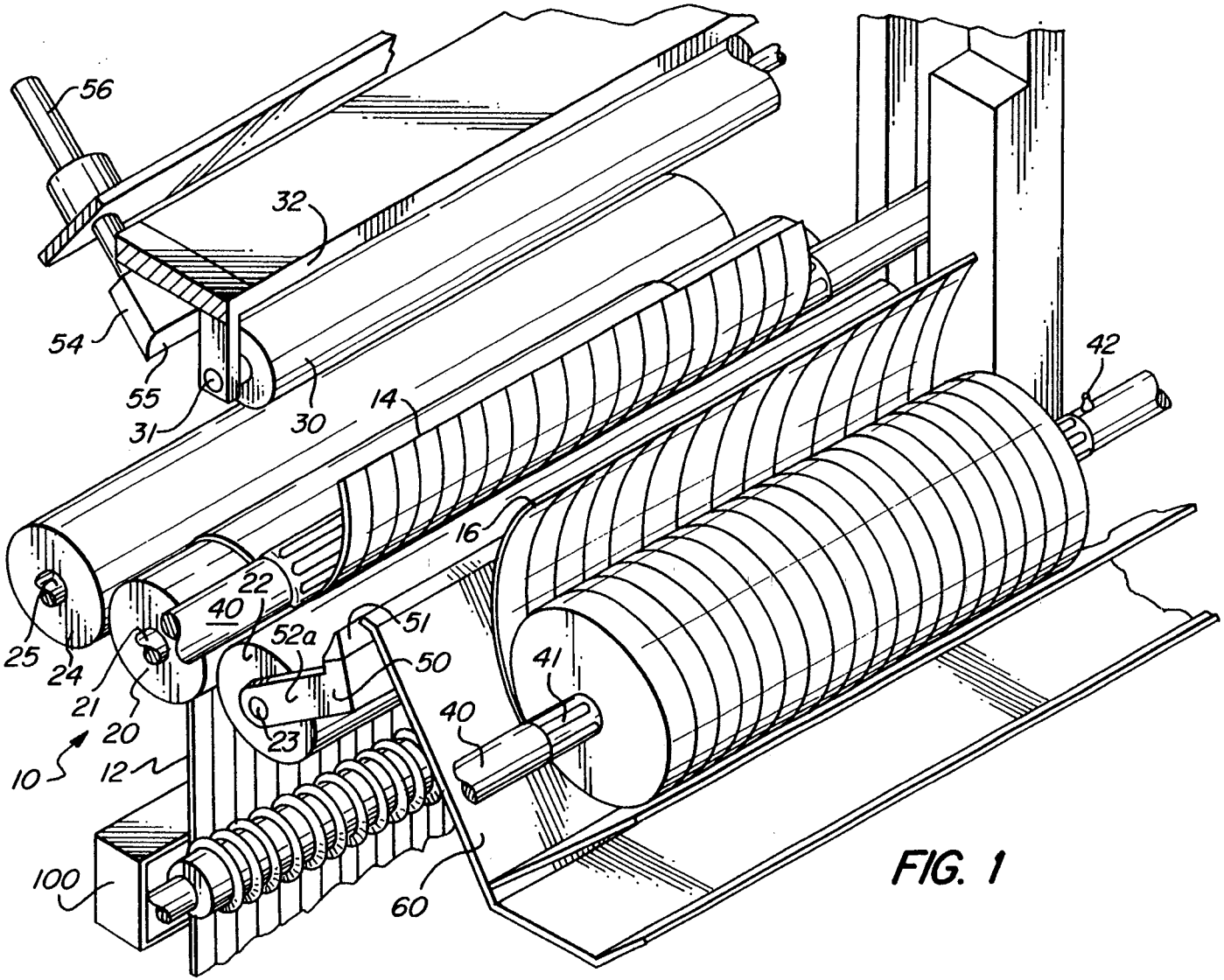
FIG. 1 is a perspective view of an embodiment of an apparatus for the preparation of individual wound rolls from a slitted web of material in accordance with the invention.

Referring now to FIGS. 1–14*bb*, where like elements are identified by like numbers in the drawings, an apparatus is shown generally at 10, which is suited for preparing individual wound rolls from a slitted web of material 12.

Apparatus 10 generally comprises a driver roller 20, which rotates about a central axis defined by a central shaft 21. Driver roller 20 feeds into apparatus 10 a slitted web of material 12 received from a slitting apparatus, denoted herein as 100. Slitted web of material 12 is fed about driver roller 20 and into contact with an idler roller 22, which freely rotates about a central axis defined by a central shaft 23. The central shaft 23 of idler roller 22 is substantially parallel to the central shaft 21 of driver roller 20.

In addition, apparatus 10 advantageously comprises a nip roller 24 which rotates about a central axis defined by a central shaft 25, and which cooperates with driver roller 20 to feed slitted web of material 12 about driver roller 20. Central shaft 25 of nip roller 24 is also substantially parallel to central shaft 21 of driver roller 20, and central shaft 23 of idler roller 22. Both idler roller 22 and nip roller 24 flank driver roller 20, such that idler roller 22 and nip roller 24 are disposed approximately 180° apart on either side of driver roller 20.

Apparatus 10 also comprises a driven reciprocating roller 30 mounted in a frame 32 which reciprocates towards and away from driver roller 20 and idler roller 22 by means of hydraulic apparatus 38, having a hydraulic driver 39 and posts 38*a* and 38*b*, which move frame 32 towards and away from driver roller 20 and idler roller 22. Reciprocating roller 30 rotates about a central axis defined by a central shaft 31 and initiates winding of slitted web of material 12, as discussed in more detail hereinbelow.

Apparatus 10 also comprises a core 40 on which the slitted web of material 12 is to be wound to form a rolled strip. Core 40 is disposed in relation to driver roller 20 and idler roller 22 such that the web of material 12, when it passes about driver roller 20, passes between and into contact with both core 40 and driver roller 20, and then between and into contact with both core 40 and idler roller 22.

In a unique and advantageous aspect of this invention, core 40 can comprise an expandable jacket, such as a bladder 41. This permits core 40 to be expanded when in position to have slitted web of material 12 wound thereabout. However, when it is desired to remove the individual rolls of slitted web of material 12 from about core 40, core 40 is deflated to facilitate removal.

A leading edge 14 of the slitted web of material 12 is then tucked about core 40 by tucking apparatus, which generally comprises a first tucker 50 and a second tucker 54. First tucker 50 comprises a first tucking bar 51, which should extend at least the entire crosswise width of slitted web of material 12. First tucking bar 51 extends from legs 52*a* and 52*b*, mounted on central shaft 23 of idler roller 22, such that first tucker 50 pivots about central shaft 23 of idler roller 22 in order to guide the leading edge 14 of slitted web of material 12 between core 40 and reciprocating roller 30. Second tucker 54 comprises a second tucking bar 55, which also extends at least the entire crosswise width of slitted web of material 12. Second tucking bar 55 is disposed on extension shaft 56 which, when extended, causes second tucking bar 55 to guide the leading edge 14 of slitted web of material 12 between core 40 and driver roller 20.

The first and second trucker have a substantially concave surface 53, 57, respectively, so as to contact the core at a plurality of points. The tucker surfaces 53, 57 each have a radius of concavity approximately equal to the radius of the core. See FIGS. 3, 4, 8, 9, 10.

First tucker 50 and second tucker 54 cooperate with reciprocating roller 30 to tuck slitted web of material 12 about core 40 in order to initiate winding of slitted web of material 12 about core 40. In doing so, first tucker 50 first guides leading edge 14 of slitted web of material 12 between core 40 and reciprocating roller 30. Reciprocating roller 30 then guides leading edge 14 into position for second tucker 54 to guide between core 40 and driver roller 20 to begin the winding process.

In order to feed slitted web of material 12 about driver roller 20, driver roller 20 is operably connected with a motor and transmission (not shown) which rotatably drives driver roller 20 to feed slitted web of material 12 thereabout, between driver roller 20 and nip roller 24. The particular motor and transmission used is not critical and is within the ordinary skill of the skilled artisan.

Each of the first and second tuckers 50 and 54 are movable to a retracted position from their tucking positions to permit rapid rolling of the web of material 12 onto core 40. For example, first tucker 50 is shown in the retracted position in FIGS. 2, 3, and 6–13, and in tucking positions in FIGS. 4 and 5. Second tucker 54 is in its retracted position in FIGS. 2–5, and 8–13, and in its tucking position in FIGS. 6 and 7. Advantageously, the tuckers 50 and 54 are pneumatically actuated to be positioned for tucking when needed, but are otherwise retracted to reduce unnecessary drag on the web of slitted material 12. In a preferred embodiment of the invention, driver roller 20, first tucker 50, second tucker 54, reciprocating roller 30, and frame 32 are independently driven, and coordinated by a computer.

Figure 12:
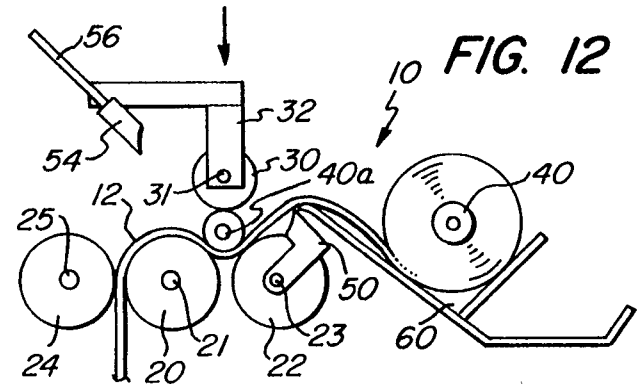
Figure 13:
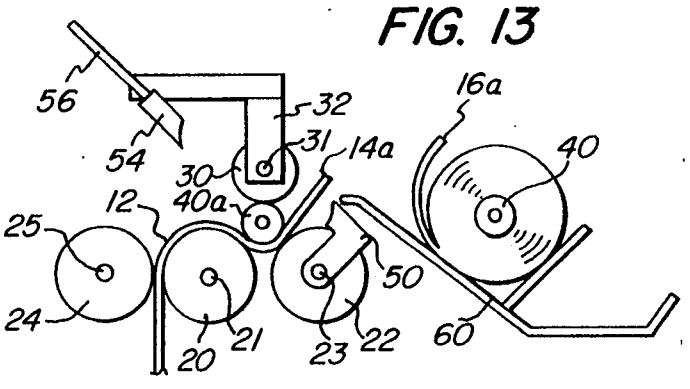
Figure 14:
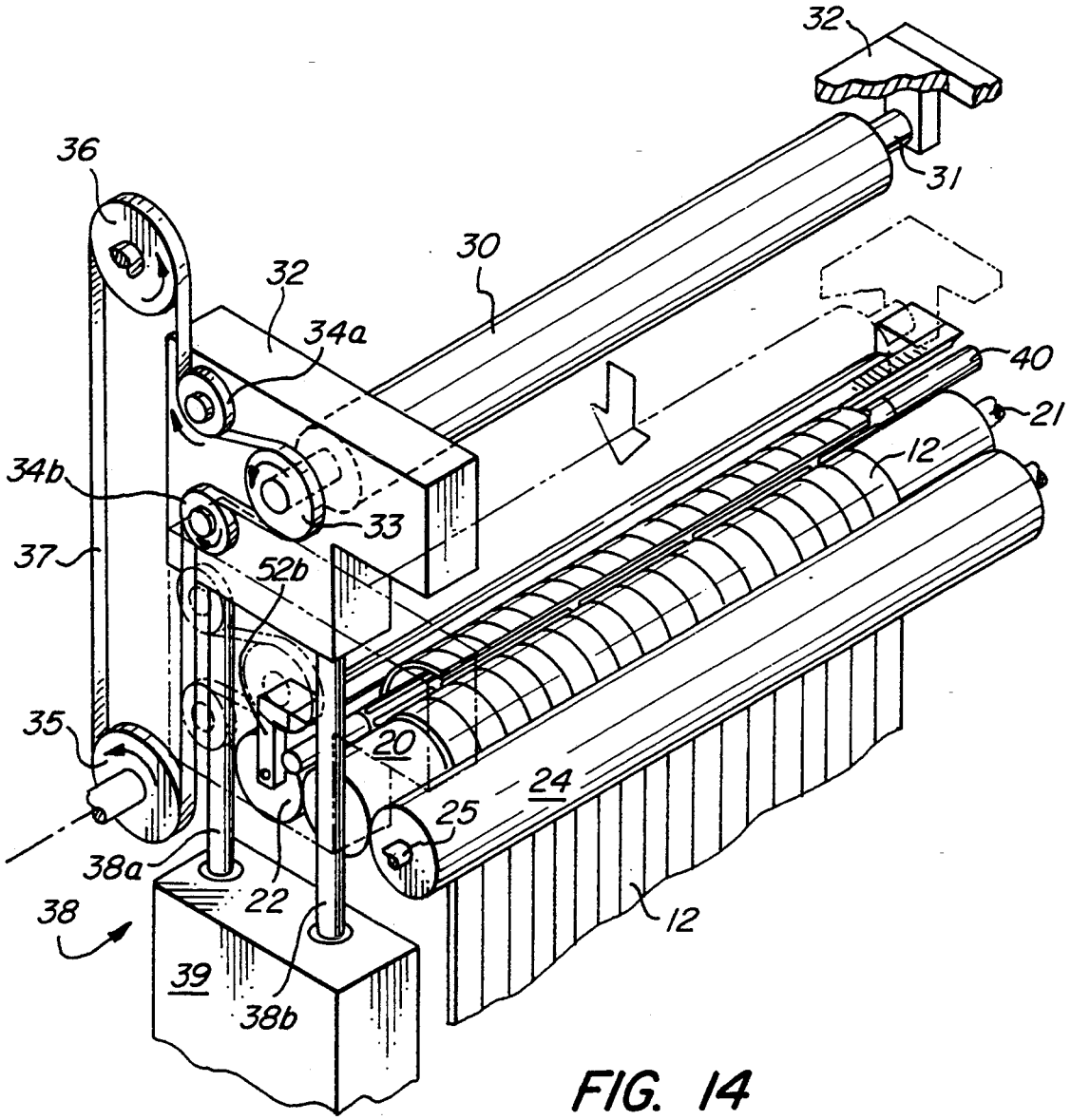
FIG. 14 is a perspective view of the apparatus for preparing individual wound rolls from a slitted web of material in accordance with FIG. 1, showing the reciprocating roller and its frame in its upper position and, in phantom, in its lower position.
Figure 14A:
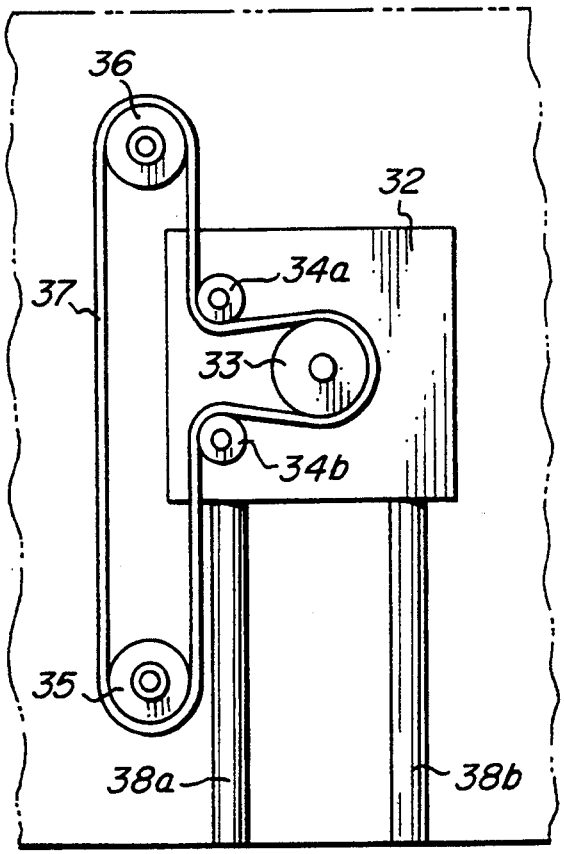
FIG. 14*aa* is a side plan view of the frame of the reciprocating roller of the apparatus for preparing individual wound rolls of a slitted web of material.
Figure 14B:
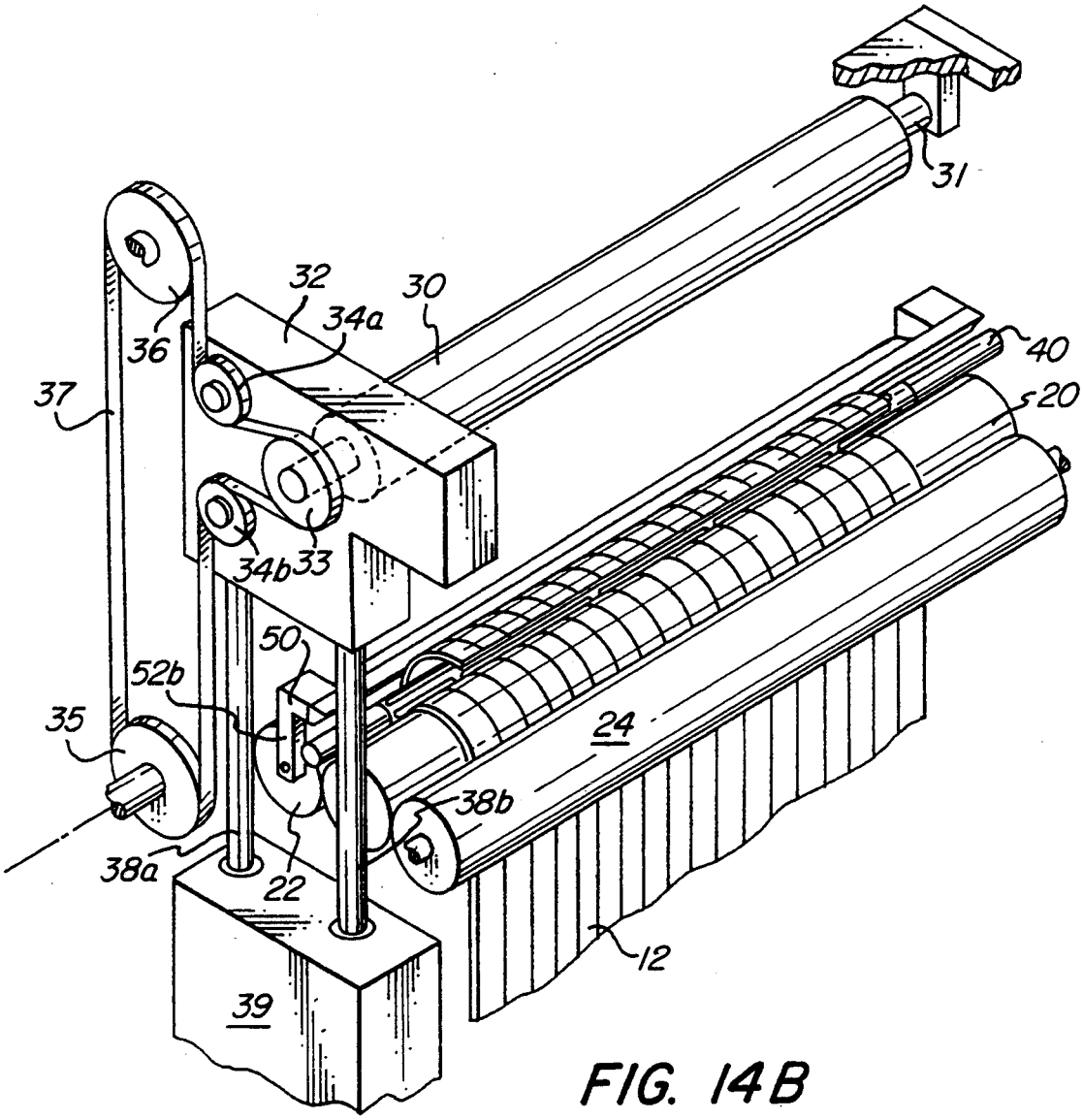
FIG. 14*bb* is a perspective view of the apparatus of FIG. 1 showing the reciprocating roller and frame in its upper position.

Initiation of winding of slitted web of material 12 about core 40 is performed by reciprocating roller 30 which is disposed within a frame 32. After first tucker 50 initiates tucking of slitted web of material 12, frame 32, as illustrated in FIGS. 14, 14*aa*, and 14*bb*, lowers reciprocating roller 30 towards core 40 during which time reciprocating roller 30 rotates in the direction of winding of core 40. That is, when core 40 is winding in a counterclockwise direction as illustrated in FIGS. 2–13, reciprocating roller 30 rotates in a clockwise direction in order to initiate winding. Once winding is initiated and reciprocating roller 30 is in position abuting core 40, reciprocating roller 30 continues to rotate to wind slitted web of material 12 about core 40 which is also being driven by driving roller 20.

Reciprocating roller 30 floats on the slitted web of material 12 and the distance between reciprocating roller 30 and core 40 increases as the amount of slitted web of material 12 wound about core 40 increases. Alternatively, reciprocating roller 30 can be forced against the slitted web of material 12 by pneumatic apparatus 38, to cause slitted web of material 12 to be wound more tightly about core 40.

Reciprocating roller 30 is rotationally driven by a drive pulley 35, which is operably connected to a motor, clutch, and transmission (not shown). Drive pulley 35 is in operable connection with reciprocating roller 30 via roller pulley 33 through an endless toothed belt 37. Roller pulley 33 rotatably drives central shaft 31 which causes reciprocating roller 30 to rotate.

As noted, reciprocating roller 30 is disposed within frame 32, which is raised and lowered by the action of pneumatic apparatus 38. Also disposed on frame 32 are a pair of idler pulleys, 34*a* and 34*b*, in a generally vertical plane such that roller pulley 33 lies on one side of the plane, as illustrated in FIGS. 14, 14*aa* and 14*bb*. Drive pulley 35 is disposed on apparatus 10 such that its position is fixed with respect to frame 32 (and, therefore, idler pulleys 34*a* and 34b and roller pulley 33). In addition, a fixed pulley 36 is disposed on apparatus 10 such that its position is fixed with respect to frame 32. Drive pulley 35 and fixed pulley 36 are arranged in a generally vertical plane, substantially parallel to the plane of idler pulleys 34*a* and 34*b*. The plane of drive pulley 35 and fixed pulley 36 lies on the opposite side of the plane of idler pulleys 34*a* and 34*b* as does roller pulley 33.

Endless toothed belt 37 is disposed about driver pulley 35 as noted, and fixed pulley 36. It then extends about idler pulleys 34*a* and 34*b* and roller pulley 33. Both idler pulleys 34*a* and 34*b* and roller pulley 33 are disposed on frame 32 such that when frame 32 is moved towards or away from driver roller 20 and idler roller 22 by the action of pneumatic apparatus 38, tension is constantly maintained on endless toothed belt 37. This is ensured by the fact that idler pulleys 34*a* and 34*b* are constantly maintained between drive pulley 35 and fixed pulley 36, which maintains the tension on endless toothed belt 37. In this way, as pneumatic apparatus 38 lowers frame 32, roller pulley 33 is slowly rotated because of its downward motion with respect to endless toothed belt 37, which is stopped. Reciprocating roller 30 is thereby slowly rotated in order to initiate winding of slitted web of material 12 about core 40.

Rotation of reciprocating roller 30 is then continued when drive pulley 35 is rotated. Reciprocating roller 30 moves away from core 40 as the amount of slitted web of material 12 wound about core 40 increases, but it continues to wind slitted web of material 12 about core 40 due to the rotational action imparted by drive pulley 35.

As noted above, pneumatic apparatus 38 can control the movement of reciprocating roller 30 away from core 40 as slitted web of material 12 is wound thereabout. The pressure exerted by reciprocating roller 30 on wound web of slitted material 12 can be varied in this manner to dictate how tightly slitted web of material 12 is wound about core 40. In other words, if pneumatic apparatus 38 maintains reciprocating roller 30 such that it exerts a great deal of pressure on slitted web of material 12, then slitted web of material 12 will be more tightly wound than it otherwise would have been. In addition, the winding tightness of slitted web of material 12 wound about core 40 can be controlled by overdriving or underdriving reciprocating roller 30 (by operation of the clutch arrangement in operative connection with drive pulley 35).

When the desired amount of slitted web of material 12 is wound about core 40, core 40 is removed from its position in relation to driver roller 20 and idler roller 22 and moved into an unloading area 60. This can conveniently be accomplished, for instance, by halting the rotation of driver roller 20 and reciprocating roller 30, moving reciprocating roller 30 away from core 40 by pneumatic apparatus 38, and removing core 40 by hand into unloading area 60.

Once core 40 has been removed to unloading area 60, slitted web of material 12 is then cut by conventional means, such as a slitter knife, which creates a trailing end 16*a* and a leading end 14*a* for beginning the winding process anew. In one alternative embodiment, first tucker 50 may be provided with a knife edge to perform this cutting step.

Referring now to FIGS. 2–13, a complete cycle illustrating the preparation of individual wound rolls of slitted web of material 12 is shown. FIGS. 2–13 are schematic views which correspond generally to the view of apparatus 10 shown in FIG. 1.

Figure 2:
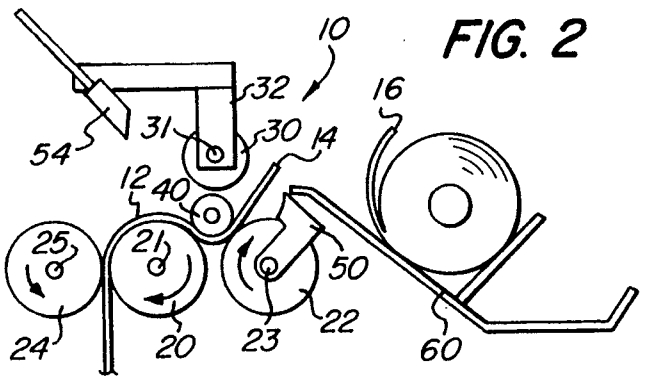

As can be seen from FIGS. 2–13, driver roller 20 and idler roller 22, are each travelling in a generally clockwise direction, whereas nip roller 24 is travelling in a generally counterclockwise direction. Reciprocating roller 30 travels in a clockwise direction, except when it slowly rotates as frame 32 is raised. Referring now to FIG. 2, a previous roll of slitted web of material 12 has been removed and sits in unloading area 60 for removal therefrom, after cutting which creates a trailing edge 16 and a leading edge 14 of slitted web of material 12. Slitted web of material 12 has fed about driver roller 20 by the action of driver roller 20 in cooperation with nip roller 24, none of which are now rotating. Core 40 has been disposed such that slitted web of material 12 is disposed about driver roller 20 and into contact with and between driver roller 20 and core 40, and between and into contact with idler roller 22 and core 40.

Figure 3:
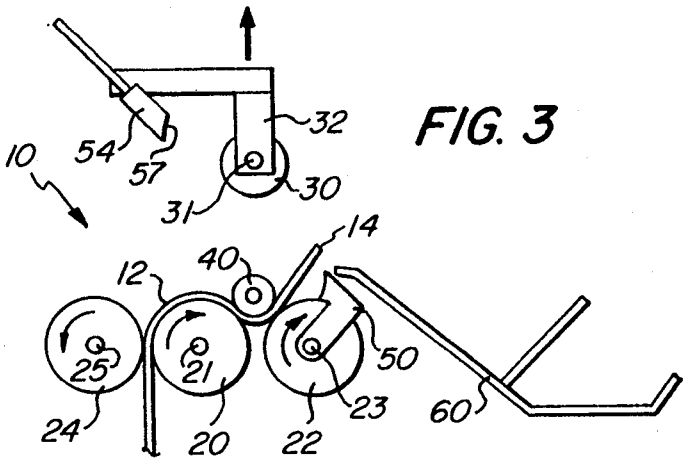
FIGS. 2–13 are schematic representations of the apparatus for preparation of individual rolls of the slitted web of material in accordance with the invention, showing the respective paths of the reciprocating roller and tuckers, and the operation of the driver and idler rollers during a complete cycle of the apparatus.

Referring now to FIG. 3, reciprocating roller 30 is moved away from core 40 by pneumatic apparatus 38, to facilitate the initiation of tucking. At this point, and referring now to FIG. 4, first tucker 50 rotates about central shaft 23 of idler roller 22 to guide leading edge 14 between core 40 and reciprocating roller 30. This is accomplished during the pivoting of first tucker 50 about central axis 23 of idler roller 22 because first tucking bar 51 physically guides leading edge 14 of slitted web of material 12 about core 40.

Figure 5:
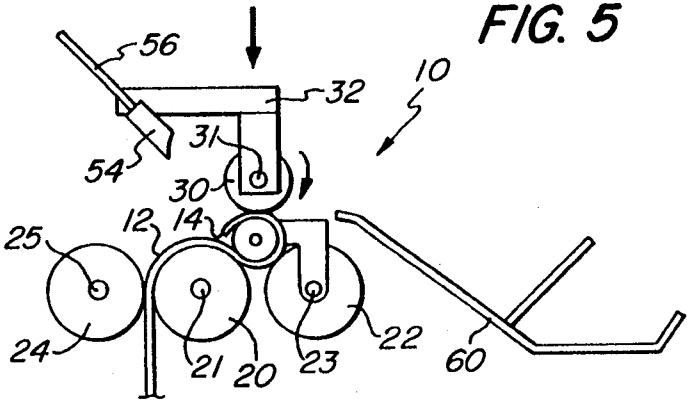
Figure 4:
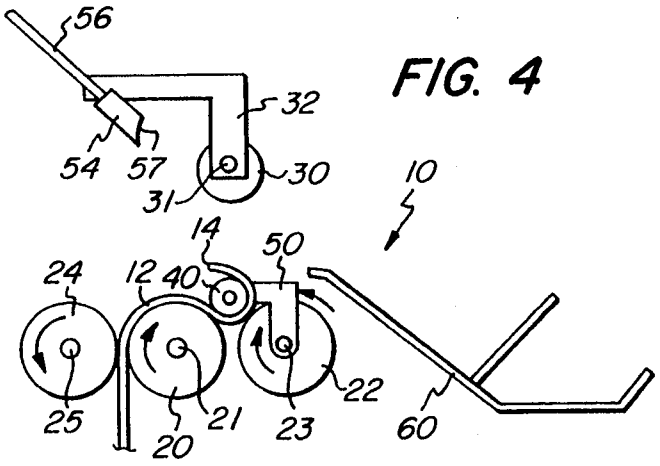

Referring now to FIGS. 4 and 5, reciprocating roller 30 is lowered towards core 40 by pneumatic apparatus 38, and is now slowly rotating in a generally clockwise direction, where it contacts slitted web of material 12 and curls or drives its leading edge 14 about core 40. The action of reciprocating roller 30 drives core 40 to begin rotation thereof and place the leading edge 14 of slitted web of material 12 about core 40 and in position for tucking by second tucker 54.

Figure 6:
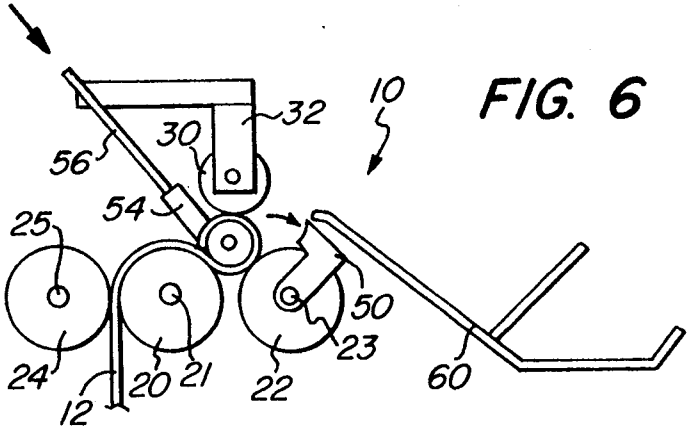

Referring now to FIG. 6, as winding of slitted web of material 12 about core 40 is begun, second tucker 54 is brought into position by extension shaft 56 and guides leading edge 14 of slitted web of material 12 about core 40 and between core 40 and slitted web of material 12 as it comes about driver roller 20. Second tucking bar 55 physically causes this second tucking action. Meanwhile, first tucker 50 has been withdrawn from its tucking position in relation to core 40.

Figure 7:
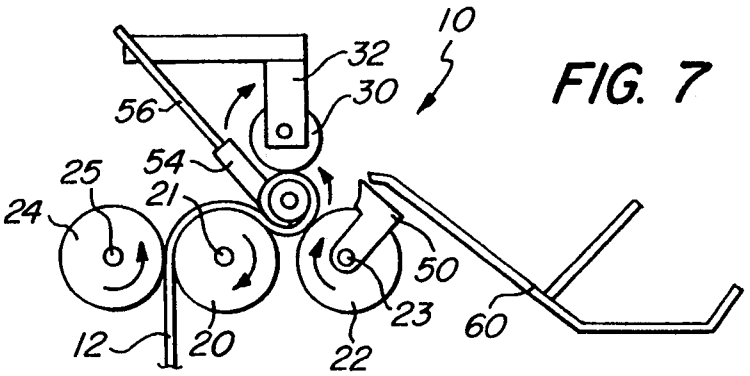
Figure 8:
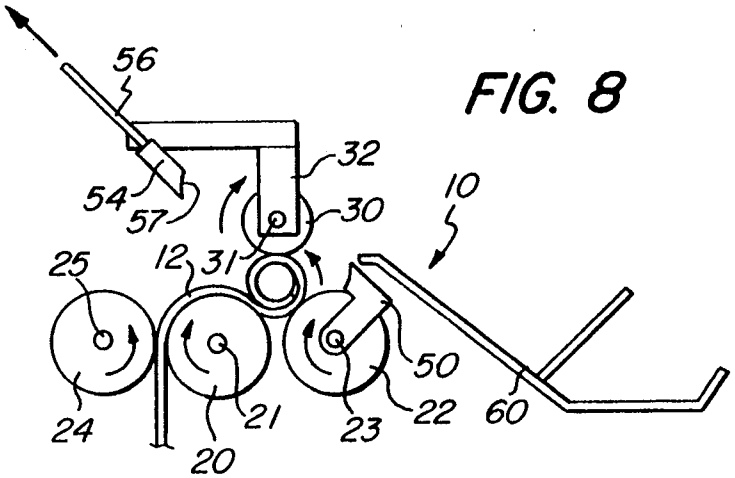

Referring now to FIG. 7, reciprocating roller 30 is driven by drive pulley 35 (shown in FIG. 14) and the rotational action of driver roller 20 and reciprocating roller 30 drives core 40 to wind slitted web of material 12 thereabout. Referring now to FIG. 8, as winding continues, second tucker 54 is withdrawn from the vicinity of core 40 to permit continued winding.

Figure 9:
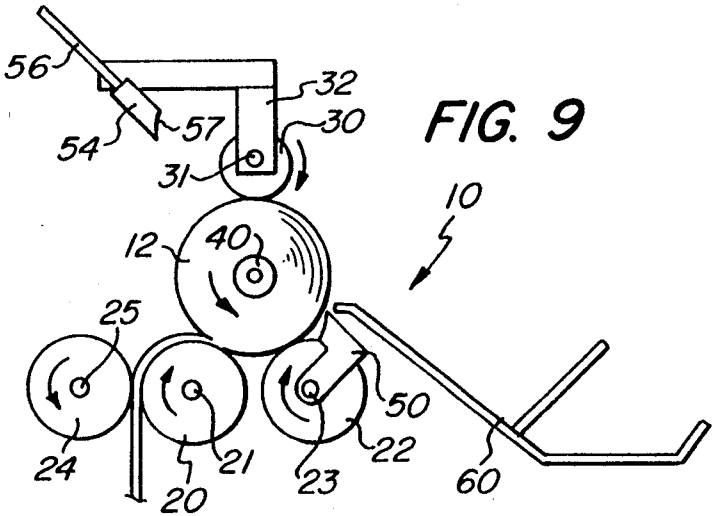
Figure 10:
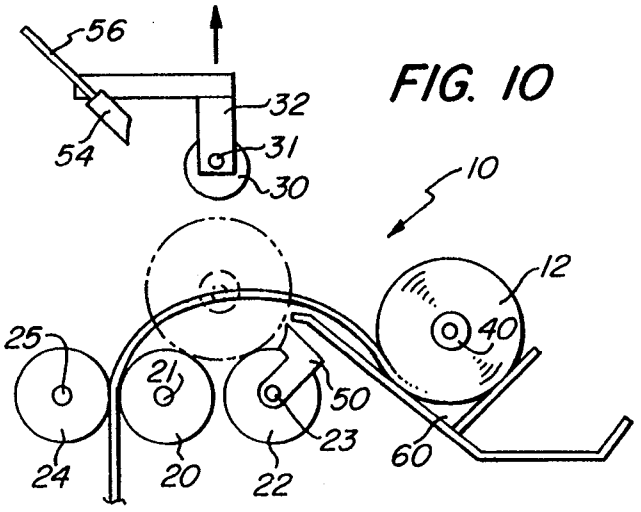

Referring now to FIG. 9, as winding of slitted web of material 12 about core 40 continues, reciprocating roller 30 is lifted away from core 40 by the thickness of slitted web of material 12 wound about core 40, although hydraulic apparatus 38 may maintain pressure on core 40 (and/or be overdriven or underdriven) to ensure the desired degree of tension on slitted web of material 12. When a desired thickness of slitted web of material is wound about core 40, referring now to FIG. 10, rotation of driver roller 20 and reciprocating roller 30 is halted, pneumatic apparatus 38 lifts reciprocating roller 30 away from core 40 and core 40 is removed to unloading area 60.

Figure 11:
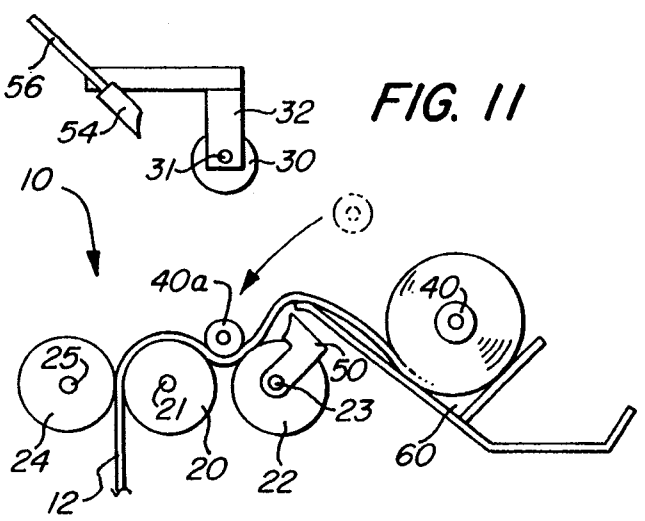

Referring now to FIG. 11, a new core 40*a* is then disposed in apparatus 10 in relation to driver roller 20 and idler roller 22 to facilitate the initiation of the process anew. Referring now to FIGS. 12 and 13, reciprocating roller 30 is then once more brought into contact with core 40 to begin the tucking and winding process, slitted web of material 12 is cut to provide a new rearward edge 16*a* and a new forward edge 14*a*.

FIGS. 2–13 display all the stages of a cycle of apparatus 10. It is to be appreciated that the cycle repeats and that FIG. 2 shows the next stage of the cycle after FIG. 13.

A method for preparing individual wound rolls from a slitted web of material in accordance with the invention generally follows the operation of apparatus 10 discussed above, and involves feeding the web of material about a driver roller and into contact with an idler roller; and tucking the web of material about a core which has been disposed in relation to the driver roller and idler roller such that the slitted web of material passes between and into contact with both the driver roller and the core, and both the idler roller and the core. The slitted web of material is then wound about the core, and the core removed from its position when a desired amount of slitted web of material is wound about the core. The slitted web of material is then cut. Initiation of winding is accomplished using a reciprocating roller which rotates in the winding direction when lowered onto the core, as well as the tuckers which wrap the web about the core at the start of winding.

The present invention, therefore, provides a new and useful apparatus and method for preparing individual wound rolls from a slitted web of material, particularly a slitted sheet of postage stamps.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A method for preparing wound rolls from a slitted web of material which comprises:

feeding a web of material about a driver roller and into contact with an idler roller;

tucking said web of material about a core disposed in relation to said driver roller and said idler roller, such that the web of material passes between and into contact with said driver roller and said core, and said idler roller and said core;

inflating said core to facilitate removal of rolled web material from said core;

initiating winding said web of material about said core;

deflating said core after winding thereabout of said web of material to facilitate removal of the rolled web of material from said core; and removing said core from its position in relation to said driver roller and said idler roller when a desired amount of web material is wound about said core, mounting a reciprocating roller in a frame, extending a toothed belt about a pair of idler pulleys on said reciprocating roller frame and a roller pulley on said reciprocating roller frame in a plane on a first side of said idler pulleys, said roller pulley operably connected to said reciprocating roller to drive said reciprocating roller, and affixing a pair of fixed pulleys around which the belt extends in a plane on a second side of said pair of idler pulleys, one of said fixed pulleys being driven.

2. An apparatus for preparing individual wound rolls from a slitted web of material, comprising:

a driver roller which rotates about a central axis and feeds the web of material about said driver roller;

an idler roller which freely rotates about a central axis, said idler roller flanking said driver roller wherein the central axis of said idler roller lies in approximately the same plane as the central axis of said driver roller, such that the web of material is fed about said driver roller and into contact with said idler roller;

a core disposed in relation to said driver roller and said idler roller such that the web of material passes between and into contact with said driver roller and said core, and said idler roller and said core;

a tucking means for tucking the web of material about said core after the web of material has contacted said idler roller, wherein said tucking means comprises:

a first tucker which guides a leading edge of the web of material between said core and a reciprocating roller, wherein said first tucker comprises a first tucking bar extending at least the width of the web of material, said first tucking bar having a leg at each end which extends to a shaft which defines the central axis of said idler roller, such that said first tucker pivots about said central shaft to guide the web of material between said core and said reciprocating roller; and a second tucker which guides the leading edge of the web of material between said core and said driver roller, said second tucker comprising a second tucking bar extending at least the width of the web of material, said second tucking bar mounted on an extending rod such that extension of said extending rod causes said second tucker to guide the web of material between said core and said driver roller, wherein said first tucker and said second tucker cooperate to first guide the web of material between said core and said reciprocating roller and then guide the web of material between said core and said driver roller in order to assist in initiating winding of the web of material about said core, and wherein each of said first tucker and said second tucker is withdrawn from its tucking position after the slitted web of material is tucked about said core;

said reciprocating roller being rotationally driven for driving said core to initiate tucking and winding of slitted web of material about said core, means for moving said reciprocating roller towards and away from said core and for rotationally driving said reciprocating roller regardless of its position with respect to said core, and wherein said reciprocating roller is drivably moved into position to drive said core immediately after said first tucker has guided the web of material between said core and said reciprocating roller, and rotatably drives said core to initiate winding of the web of the material about said core as said second tucker is guiding the web of the material said core and said driver roller.

3. An apparatus for preparing individual wound rolls from a slitted web of material, comprising:

a driver roller which rotates about a central axis and feeds the web of material about said driver roller;

an idler roller which freely rotates about a central axis, said idler roller flanking said driver roller wherein the central axis of said idler roller lies in approximately the same plane as the central axis of said driver roller, such that the web of material is fed about said driver roller and into contact with said idler roller;

a core disposed in relation to said driver roller and said idler roller such that the web of material passes between and into contact with said driver roller and said core, and said idler roller and said core;

a tucking means for tucking the web of material about said core after the web of material has contacted said idler roller, said tucking means comprising:

a first tucker which guides a leading edge of the web of material between said core and a reciprocating roller; and a second tucker which guides the leading edge of the web of material between said core and said driver roller, wherein said first tucker and said second tucker cooperate to first guide the wed of material between said core and said reciprocating roller and then guide the web of material between said core and said driver roller in order to assist in initiating winding of the web of material about said core, and wherein each of said first tucker and said second tucker is withdrawn from its tucking position after the slitted web of material is tucked about said core, said reciprocating roller being rotationally driven for driving said core to initiate tucking and winding of slitted web of material about said core, means for moving said reciprocating roller towards and away from said core and for rotationally driving said reciprocating roller regardless of its position with respect to said core, wherein said reciprocating roller is mounted in a frame in operable connection with a roller pulley about which is disposed an endless toothed belt which is disposed about a driver pulley and a fixed pulley, such that rotation of said roller pulley is begun by the downward moment thereof with respect to said endless toothed belt between said drive pulley and said fixed pulley, and wherein said reciprocating roller is drivably moved into position to drive said core immediately after said first tucker has guided the web of material between said core and said reciprocating roller, and rotatably drives said core to initiate winding of the web of material about said core as said second tucker is guiding the web of material between said core and said driver roller.

4. An apparatus for preparing wound rolls from a slitted web of material in accordance with claim 3, wherein said endless toothed belt extends about a pair of idler pulleys on said reciprocating roller frame, and said roller pulley being located in a plane on a first side of said idler pulleys, said roller pulley operably connected to said reciprocating roller to drive said reciprocating roller, and said drive pulley and said fixed pulley disposed fixedly with respect to said frame, in a plane on a second side of said pair of idler pulleys, said drive pulley being rotatably driven.

5. A method for preparing wound rolls from a slitted web of material which comprises:

feeding a flexible web of material about a driver roller and into contact with an idler roller;

tucking said web of material about an expanded core disposed in relation to said driver roller and said idler roller, such that said web of material passes between and into contact with said driver roller and said core, and said idler roller and said core, wherein the tucking occurs after said web of material has contacted said idler roller;

initiating winding said web of material about said expanded core;

contracting said core to facilitate removal of said web of material from said core;

removing said core from its position in relation to said driver roller and said idler roller when a desired amount of web material is wound about said core;

removing said core from said wound web of material after winding of said web has been completed; and mounting a reciprocating roller in a frame and extending a toothed belt about a pair of idler pulleys on said reciprocating roller frame and a roller pulley on said reciprocating roller frame in a plane on a first side of said idler pulleys, said roller pulley operably connected to said reciprocating roller to drive said reciprocating roller, and affixing a pair of fixed pulleys around which the belt extends in a plane on a second side of said pair of idler pulleys, one of said fixed pulleys being driven.

* * * * *